US010155236B2

(12) United States Patent
Tan et al.

(10) Patent No.: US 10,155,236 B2
(45) Date of Patent: Dec. 18, 2018

(54) COLD SPRAY NOZZLE ASSEMBLY AND A METHOD OF DEPOSITING A POWDER MATERIAL ONTO A SURFACE OF A COMPONENT USING THE ASSEMBLY

(71) Applicant: ROLLS-ROYCE plc, London (GB)

(72) Inventors: Adrian W Y Tan, Singapore (SG); Erjia Liu, Singapore (SG); Iulian Marinescu, Galati (SG)

(73) Assignee: ROLLS-ROYCE plc, London (GB)

( * ) Notice: Subject to any disclaimer, the term of this patent is extended or adjusted under 35 U.S.C. 154(b) by 0 days.

(21) Appl. No.: 15/380,625

(22) Filed: Dec. 15, 2016

(65) Prior Publication Data

US 2017/0173611 A1 Jun. 22, 2017

(30) Foreign Application Priority Data

Dec. 18, 2015 (GB) ..... 1522349.8

(51) Int. Cl.
*B05B 7/14* (2006.01)
*B05B 7/08* (2006.01)
(Continued)

(52) U.S. Cl.
CPC ..... *B05B 7/1481* (2013.01); *B05B 7/0807* (2013.01); *B05B 7/1486* (2013.01);
(Continued)

(58) Field of Classification Search
CPC ..... B05B 12/08; B05B 7/1481; C23C 24/04; F01D 5/288; F05D 2220/32; F05D 2230/31
(Continued)

(56) References Cited

U.S. PATENT DOCUMENTS

2005/0011395 A1 1/2005 Langan et al.
2007/0164131 A1* 7/2007 Kleba ..... B01F 5/205 239/433
(Continued)

FOREIGN PATENT DOCUMENTS

EP 2009132 A1 12/2008
EP 2551023 A2 1/2013
(Continued)

OTHER PUBLICATIONS

Jun. 16, 2016 Search Report issued in British Patent Application No. GB1522349.8.
(Continued)

*Primary Examiner* — Alexander M Weddle
(74) *Attorney, Agent, or Firm* — Oliff PLC

(57) ABSTRACT

A Cold spray nozzle assembly for depositing powder material onto a component surface includes a primary spray nozzle, two or more secondary spray nozzles, and a support mechanism supporting each spray nozzle. Each spray nozzle deposits powder material on a single target point on the surface, a reference plane being defined normal to a surface plane at the target point. The primary nozzle is in a primary plane that is normal to the surface plane, and that defines a primary dihedral angle with the reference plane. An axis of the primary nozzle defines a primary nozzle angle with the surface plane. Each of the secondary spray nozzles is in a corresponding secondary plane, with each being normal to the surface plane and defining a respective secondary dihedral-angle with the reference plane. An axis of each secondary spray nozzle defines a respective secondary nozzle angle with the surface plane.

18 Claims, 5 Drawing Sheets

(51) Int. Cl.
*C23C 24/04* (2006.01)
*B05B 12/08* (2006.01)
*F01D 5/28* (2006.01)

(52) U.S. Cl.
CPC ..... *B05B 12/08* (2013.01); *C23C 24/04* (2013.01); *F01D 5/288* (2013.01); *F05D 2220/32* (2013.01); *F05D 2230/31* (2013.01)

(58) Field of Classification Search
USPC ..... 427/180
See application file for complete search history.

(56) References Cited

U.S. PATENT DOCUMENTS

| | | | |
|---|---|---|---|
| 2013/0089726 | A1 | 4/2013 | Anand et al. |
| 2015/0030379 | A1 | 1/2015 | Lancaster-Larocque et al. |

FOREIGN PATENT DOCUMENTS

| | | | | | |
|---|---|---|---|---|---|
| EP | 2806049 | A1 | | 11/2014 | |
| JP | 2009132945 | A | * | 6/2009 | ..... C03C 17/23 |
| WO | 2007/105670 | A1 | | 9/2007 | |

OTHER PUBLICATIONS

May 3, 2017 Search Report issued in European Patent Application No. 16204571.0.

C.-J Li et al; "Effect of Spray Angle on Deposition Characteristics in Cold Spraying;" Thermal Spray 2003: Advancing the Science & Applying the Technology; proceedings of the 2003 International Thermal Spray Conference; May 2003; pp. 91-96.

Hamid Assadi et al; "Bonding mechanism in cold gas spraying;" Acta Meterialia; May 2003; vol. 51; No. 15; pp. 4379-4394.

* cited by examiner

COLD SPRAY NOZZLE ASSEMBLY AND A METHOD OF DEPOSITING A POWDER MATERIAL ONTO A SURFACE OF A COMPONENT USING THE ASSEMBLY

This disclosure claims the benefit of UK Patent Application No. GB 1522349.8, filed on 18 Dec. 2015, which is hereby incorporated herein in its entirety.

FIELD OF THE DISCLOSURE

The present disclosure relates to a cold spray nozzle assembly and particularly, but not exclusively, to a cold spray nozzle assembly for depositing a material onto a surface of a gas turbine blade.

BACKGROUND TO THE DISCLOSURE

Cold spraying is a relatively new low temperature coating technology that holds promise for use in repair applications of aerospace components. Cold spraying is a coating process which uses a high pressure (4 to 5 MPa) and preheated (up to 1000° C.) gas stream (for example, nitrogen or helium) to accelerate micro-particles (15 to 60 μm diameter) via a converging-diverging nozzle (de Laval) to supersonic speeds (approximately 600 to 1000 m/s) and then to impact the particles onto the substrate. The micro-particles will then plastically deform, undergo rapid interfacial melting and bond with the substrate, forming the coating.

However, a conventional cold spray nozzle arrangement, as shown in FIG. 1, only allows coating particles 10 to have perpendicular impact with the substrate 130. This results in a base section of the coating particles 10, indicated at 'A' in FIG. 1, having a strong bond with the substrate, but leaving the side portions, indicated at 'B' in FIG. 1, of the coating particles 10 either unbonded or only weakly bonded to the substrate 130. This is also confirmed by fractographic images where the side portions of the particles 10 show little bonding to the substrate 130.

STATEMENTS OF DISCLOSURE

According to a first aspect of the present disclosure there is provided a cold spray nozzle assembly for depositing a powder material onto a surface of a component, the nozzle assembly comprising:

a primary spray nozzle;

two or more secondary spray nozzles; and a nozzle support mechanism, the nozzle support mechanism being arranged to support each of the primary, and the two or more secondary, spray nozzles, wherein each of the primary, and the two or more secondary, spray nozzles are aligned to deposit the powder material on a single target point on the surface, a reference plane being defined normal to a surface plane at the target point, the primary nozzle being positioned in a primary plane, the primary plane being normal to the surface plane, and defining a primary dihedral angle with the reference plane, an axis of the primary nozzle defining a primary nozzle angle with the surface plane, each of the two or more secondary spray nozzles being positioned in a corresponding secondary plane, each of the two or more secondary planes being normal to the surface plane, and defining a respective secondary dihedral angle with the reference plane, and an axis of each of the two or more secondary spray nozzles defining a respective secondary nozzle angle with the surface plane.

Each of the primary spray nozzle and the secondary spray nozzles can be positioned with individually determined nozzle angles. These nozzle angles determine the impact angle of the powder material on the surface. The impact angle can be adjusted to suit the type of the powder material being dispensed, and the type of substrate.

A multi-angle nozzle assembly enables a cold spray coating to be applied to surfaces having complex geometric profiles, whilst maintaining the nozzle angles at particular values, or within particular ranges.

For example, on a contoured geometry component, and with three spray nozzles, one of the three spray nozzles will always be able to dispense the powder material at the surface within a range of angles around the perpendicular, as the nozzle assembly traverses the surface.

In this way, the nozzle assembly of the present disclosure can be used more time efficiently to deposit a coating material onto surfaces having complex geometries, without the need to constantly map out the surface profile prior to deposition.

Optionally, each of the two or more secondary planes is coplanar with the primary plane.

It is known that cold sprayed particles that are deposited perpendicularly to the surface are weakly bonded at their sides, relative to their base. This is because perpendicular impact converts the maximum proportion of the kinetic energy of the particle to thermal bonding. The side portions of the particles are weakly bonded to the surface because they receive less kinetic energy for thermal bonding and so are a source of failure for the coating.

By arranging the nozzles in a co-planar fashion it becomes possible for the angled impact of the particles deposited from the non-perpendicular nozzles to distribute the impact energy to the sides of the perpendicularly deposited particles. This enables the particle sides to have both inter and intra-particle bonding, so strengthening the coating layer.

Optionally, the powder material is a metal powder or a metal alloy powder.

In one arrangement of the disclosure, the metal powder may be a titanium alloy powder material. Alternatively, the powder material may be, for example, titanium, nickel, aluminium, or alloys thereof.

In an alternative arrangement of the disclosure the powder material may be a ceramic material, or in a further alternative disclosure the powder material may be a polymeric material.

Optionally, the nozzle assembly comprises a primary spray nozzle, and two secondary spray nozzles.

The use of a single primary spray nozzle and two secondary spray nozzles provides a balance between the flexibility of providing a primary spray delivery of powder material and two secondary spray deliveries of powder material, each at different nozzle angles, and the complexity of more than three spray nozzles.

Optionally, the primary nozzle angle is 90° to the surface plane at the target point.

This ensures that there is always one nozzle which is directed perpendicularly to the plane of the surface. Perpendicular impact converts the maximum proportion of the kinetic energy of the particle to thermal bonding so maximising the strength of the particle bond to the surface.

Optionally, the first secondary nozzle angle is 45° to the surface plane at the target point, and the second secondary nozzle angle is 135° to the surface plane at the target point.

This enables the particles delivered from each of the first secondary nozzle and the second secondary nozzle to impact the surface at right angles to one another. This enables the kinetic energy of the particles to be effectively translated into thermal bonding and minimises the likelihood of weak bonding developing at the side portions of the deposited particles.

The right angle between the two particle streams provides for improved particle side bonding due to the distribution of impact energy between the two particle streams.

Optionally, the first secondary nozzle angle is between 45° and 70° to the surface plane at the target point, and the second secondary nozzle angle is between 110° and 135° to the surface plane at the target point.

By varying the included angle between the particle streams of the first and second secondary materials it is possible to tailor the degree of thermal bonding of the respective particles to optimise the bonding strength of the coating.

Optionally, the primary nozzle discharges a first powder material at a first pre-determined discharge velocity, the first secondary nozzle discharges a second powder material at a second pre-determined discharge velocity, and the second secondary nozzle discharges a third powder material at a third pre-determined discharge velocity.

Where each of the primary and secondary nozzles dispenses a different powder material, each of these materials will have different thermo-mechanical properties. The Optionally, each of the second powder material and/or the third powder material is different from the first material.

The method of the disclosure may be used to deposit composite coatings such as, for example, metal/ceramic, metal/polymer, and metal/metal.

The use of three different powder materials in each of the primary and two secondary nozzles enables the ternary coating system. The three powder materials may be selected to provide a particular combination of thermo-mechanical properties to the finished coating.

Alternatively, the first powder material may be the same as the second powder material, both of which are different from the third powder material.

For example, the first and second powder materials may be a metal alloy powder, with the third powder material being a ceramic material.

Optionally, each of the first pre-determined discharge velocity, the second pre-determined discharge velocity, and the third pre-determined discharge velocity, is selected in dependence on a thermo-mechanical property of the corresponding powder material.

In order to provide optimal bonding between each of the first, second and third powder materials and the surface, it may be necessary to deliver the corresponding powder material at different discharge velocities.

Optionally, the thermo-mechanical property is selected from the group comprising melting point, yield point, flow stress, fracture toughness and strain energy release rate.

In one arrangement of the disclosure, the thermos-mechanical property governing the impact behaviour of the respective powder material and the surface is the melting point of the powder material.

In other arrangements of the disclosure, it may be more apposite to select an alternative thermos-mechanical property of the respective powder material as an arbiter of the corresponding discharge velocity.

According to a second aspect of the present disclosure there is provided a method of depositing a powder material onto a single target point on a surface of a component using a cold spray nozzle assembly, the cold spray nozzle comprising a nozzle support mechanism, the method comprising the steps of:

arranging the nozzle support mechanism to support each of a primary spray nozzle, and two or more secondary spray nozzles;

defining a reference plane normal to the surface at the target point;

positioning the primary nozzle in a primary plane, the primary plane being normal to a surface plane at the target point, and defining a primary dihedral angle with the reference plane;

positioning the two or more secondary spray nozzles, in corresponding secondary planes, each of the two or more secondary planes being normal to the surface at the target point, and defining respective secondary dihedral angles with the reference plane, and an axis of each of the two or more secondary spray nozzles defining a respective secondary nozzle angle with the surface plane;

depositing powder material on the target point using the primary spray nozzle; and depositing powder material on the target point using each of the two or more secondary spray nozzles.

Each of the primary spray nozzle and the secondary spray nozzles can be positioned with individually determined nozzle angles. These nozzle angles determine the impact angle of the powder material on the surface. The impact angle can be adjusted to suit the type of the powder material being dispensed, and the type of substrate.

A multi-angle nozzle assembly enables a cold spray coating to be applied to surfaces having complex geometric profiles, whilst maintaining the nozzle angles at particular values, or within particular ranges.

For example, on a contoured geometry component, and with three spray nozzles, one of the three spray nozzles will always be able to dispense the powder material at the surface within a range of angles around the perpendicular, as the nozzle assembly traverses the surface.

In this way, the method using the nozzle assembly of the present disclosure can be used more time efficiently to deposit a coating material onto surfaces having complex geometries, without the need to constantly map out the surface profile prior to deposition.

Optionally, the step of depositing powder material on the target point using the primary spray nozzle, comprises the step of:

discharging a first powder material through the primary spray nozzle at a first pre-determined discharge velocity to deposit the first powder material on the target point;

and the step of depositing powder material on the target point using each of the two or more secondary spray nozzles, comprises the step of:

discharging second and further powder materials through respective ones of the two or more secondary spray nozzles at corresponding second and further pre-determined discharge velocities to deposit the second and further powder materials on the target point.

Where each of the primary and secondary nozzles dispenses a different powder material, each of these materials will have different thermo-mechanical properties. The other aspects of the disclosure provide devices, methods and systems which include and/or implement some or all of the actions described herein. The illustrative aspects of the disclosure are designed to solve one or more of the problems herein described and/or one or more other problems not discussed.

BRIEF DESCRIPTION OF THE DRAWINGS

There now follows a description of an embodiment of the disclosure, by way of non-limiting example, with reference being made to the accompanying drawings in which.

It is noted that the drawings may not be to scale. The drawings are intended to depict only typical aspects of the disclosure, and therefore should not be considered as limiting the scope of the disclosure.

DETAILED DESCRIPTION

Figure 1:
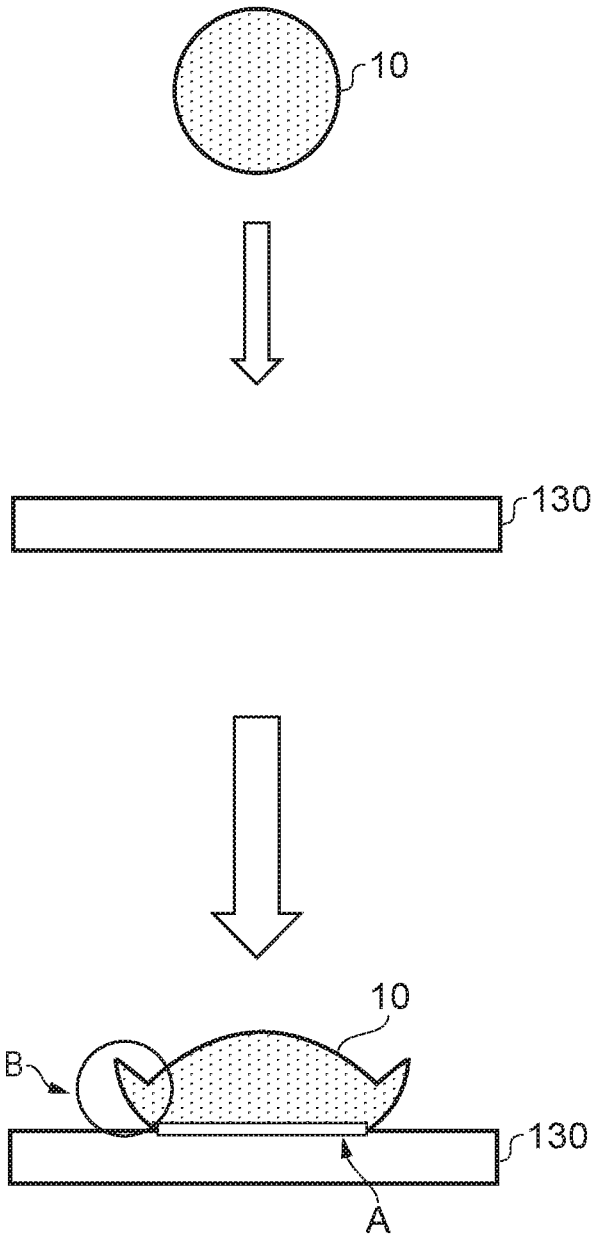
FIG. 1 (Prior Art)
FIG. 1 shows a schematic view of a cold spray process according to the prior art.
Figure 2:
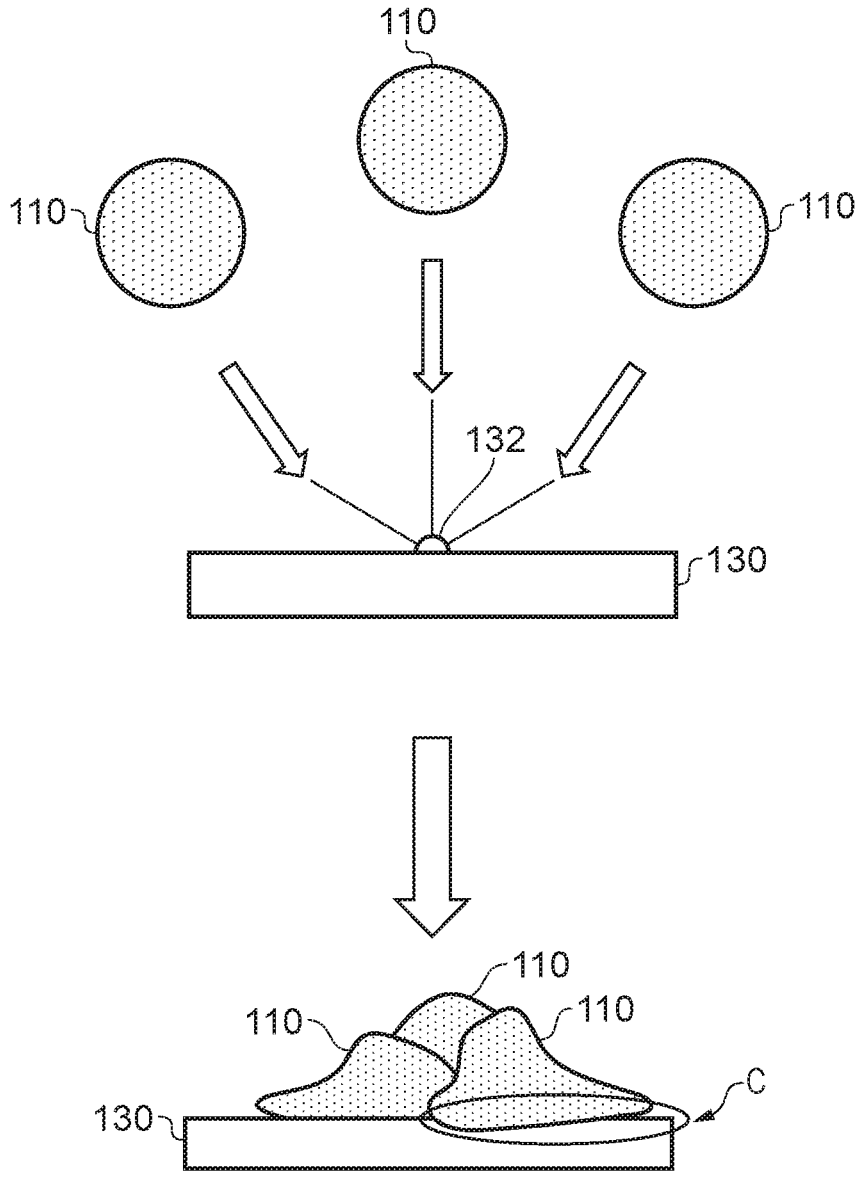
FIG. 2 shows a schematic view of a cold spray process according to a first embodiment of the disclosure, in which a single powder material is deposited on a surface of a component.
Figure 4:
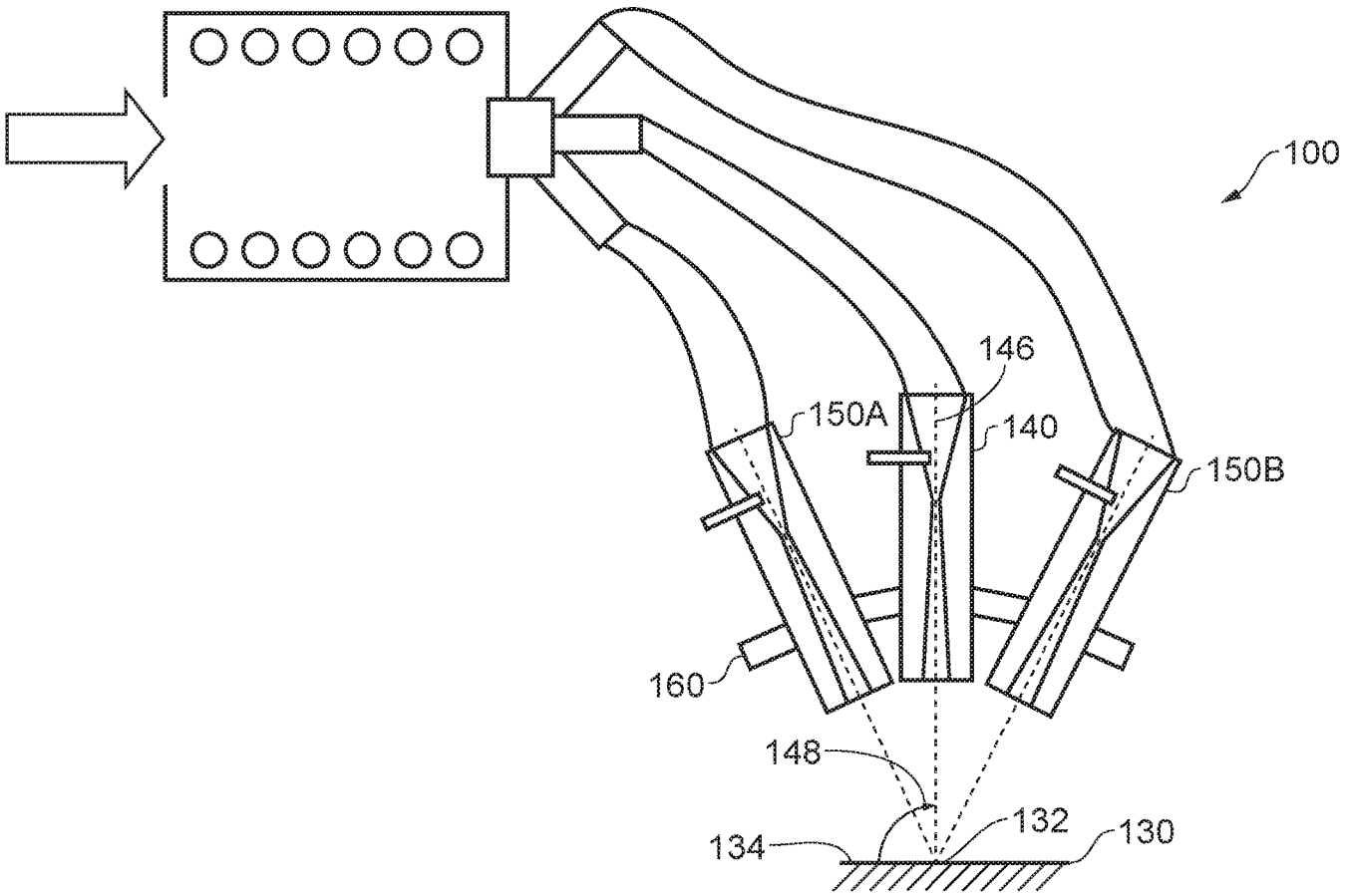
FIG. 4 shows a schematic arrangement of a cold spray nozzle assembly according to the first embodiment of the disclosure.
Figure 6:
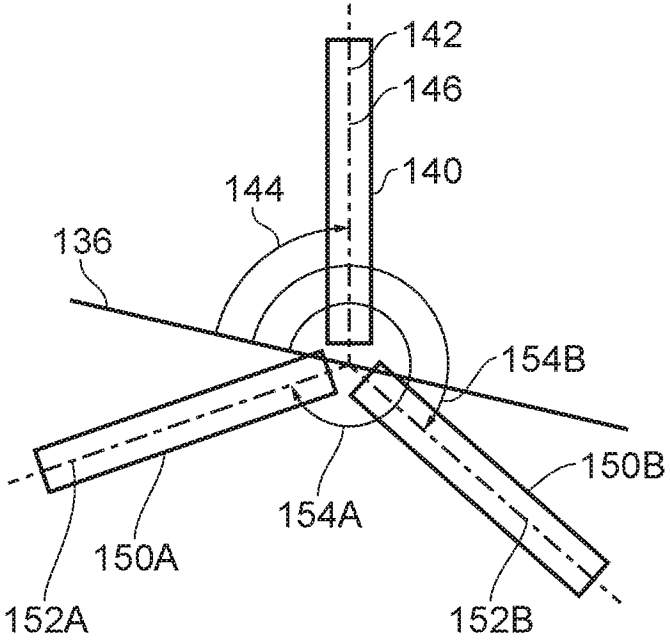
FIG. 6 shows a plan view of an alternative arrangement of the spray nozzles of the nozzle assembly of FIG. 4.
Figure 5:
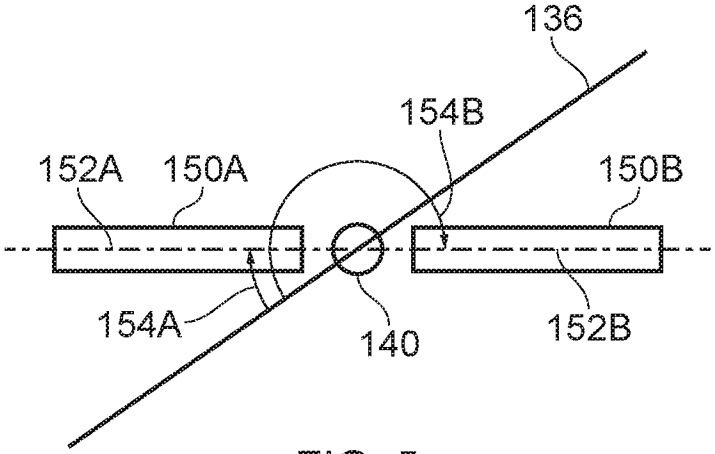
FIG. 5 shows a plan view of the spray nozzles of the nozzle assembly of FIG. 4.

Referring to FIGS. 2, 4, and 5, a cold spray nozzle assembly according to a first embodiment of the disclosure is designated generally by the reference numeral 100.

The cold spray nozzle assembly 100 comprises a primary spray nozzle 140, a first secondary spray nozzle 150A, a second secondary spray nozzle 150B, and a nozzle support mechanism 160.

The nozzle support mechanism 160 is arranged to support each of the primary spray nozzle 140, the first secondary spray nozzle 150A, and the second secondary spray nozzle 1506. The nozzle support mechanism 160 can be adjusted to alter the orientation of each of the primary spray nozzle 140, the first secondary spray nozzle 150A, and the second secondary spray nozzle 150B as outlined in more detail below.

Each of the primary spray nozzle 140, the first secondary spray nozzle 150A, and the second secondary spray nozzle 150B are aligned to deposit a powder material 110 on a single target point 132 on a surface 130 of a component (itself not shown).

The first primary spray nozzle 140, the first secondary spray nozzle 150A, and the second secondary spray nozzle 150B are themselves conventional cold spray nozzles about which no further technical detail is therefore required.

A reference plane 136 is defined normal to a surface plane 134 of the surface 130 at the target point 132. The reference plane 136 is itself used for defining the relative positioning of the primary spray nozzle 140, the first secondary spray nozzle 150A, and the second secondary spray nozzle 150B. The absolute choice of orientation of the reference plane 136 is in itself unimportant.

The primary spray nozzle 140 is positioned in a primary plane 142, the primary plane 142 being normal to the surface plane 134. The primary plane 142 defines a primary dihedral angle 144 between the primary plane 142 and the reference plane 136.

The primary spray nozzle 140 has a primary axis 146, with the primary axis 146 defining a primary nozzle angle 148 with the surface plane 134.

The first secondary spray nozzle 150A is positioned in a first secondary plane 152A, the first secondary plane 152A being normal to the surface plane 134. The first secondary plane 152A defines a first secondary dihedral angle 154A between the first secondary plane 152A and the reference plane 136.

The second secondary spray nozzle 150B is positioned in a second secondary plane 152B, the second secondary plane 152B being normal to the surface plane 134. The second secondary plane 152B defines a second dihedral angle 154B between the second secondary plane 152B and the reference plane 136.

In the present embodiment, each of the first secondary plane 152A and the second secondary plane 152B is coplanar with the primary plane 142. FIG. 5 shows a plan view of the orientation of the primary spray nozzle 140, the first secondary spray nozzle 150A, and the second secondary spray nozzle 150B of the cold spray nozzle assembly 100 illustrated in FIG. 4.

As indicated in FIG. 5, the orientation of the reference plane 136 is arbitrary. The primary spray nozzle 140 is oriented normally (i.e. 90°) to the surface plane 134 and therefore the primary dihedral angle 144 between the primary plane 142 and the reference plane 136 is 0°. The first secondary dihedral angle 154A defines the angular position of the first secondary plane 152A relative to the reference plane 136. The second secondary dihedral angle 154B defines the angular position of the second secondary plane 152B relative the reference plane 136.

In this embodiment, the first secondary dihedral angle 154A is 30°, and the second secondary dihedral angle 154B is 210°. Consequently, the first secondary plane 152A is coplanar with the second secondary plane 152B, and both are coplanar with the primary plane 142.

In an alternative embodiment of the disclosure, the primary spray nozzle 140 is oriented at an angle other than 90° to the surface plane 134, and consequently the angular position of the primary plane 142 relative to the reference plane 136 is defined by the primary dihedral angle 144, the angular position of the first secondary plane 152A relative to the reference plane 136 is defined by the first secondary dihedral angle 154A, and the angular position of the second secondary plane 152B is defined by the second secondary dihedral angle 154B.

In use, as shown schematically in FIG. 2, a powder material 110 is discharged through each of the primary spray nozzle 140, the first secondary spray nozzle 150A and the second secondary spray nozzle 150B at the target point 132 on the surface 130.

In this arrangement, the same powder material 110 is discharged through each of the primary spray nozzle 140, the first secondary spray nozzle 150A, and the second secondary spray nozzle 150B at the target point 132.

Figure 3:
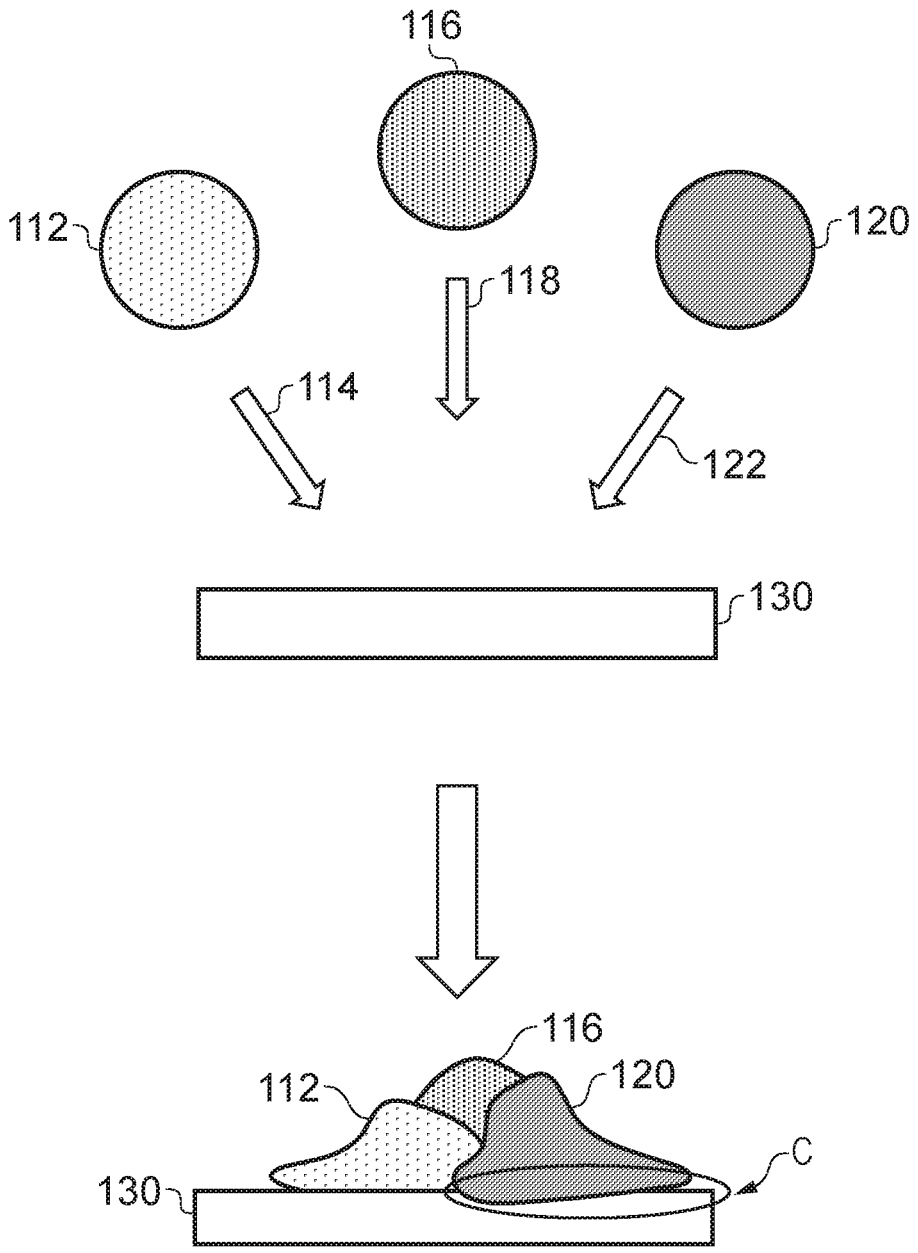
FIG. 3 shows a schematic view of a cold spray process according to a second embodiment of the disclosure, in which a three different powder materials are simultaneously deposited on a surface of a component.

In an alternative embodiment of the disclosure, shown schematically in FIG. 3, a first powder material 112 is discharged through the primary spray nozzle 140, a second powder material 116 is discharged through the first secondary spray nozzle 150A, and a third powder material is discharged through the second secondary spray nozzle 150B. For example, the first powder material 112 may be aluminium, the second powder material 116 may be nickel, and the third powder material 120 may be titanium.

In this alternative arrangement, each of the first, second and third powder materials 112,116,120 may be discharged from the corresponding spray nozzles 140,150A,150B at different discharge velocities. The first powder material is discharged from the primary spray nozzle 140 at a first pre-determined discharge velocity 114, the second powder material 116 is discharged from the first secondary nozzle 150A at a second pre-determined discharge velocity 118, and the third powder material 120 is discharged from the second secondary nozzle 150B at a third pre-determined discharge velocity 122.

Except where mutually exclusive, any of the features may be employed separately or in combination with any other features and the disclosure extends to and includes all combinations and sub-combinations of one or more features described herein.

The foregoing description of various aspects of the disclosure has been presented for purposes of illustration and description. It is not intended to be exhaustive or to limit the disclosure to the precise form disclosed, and obviously, many modifications and variations are possible. Such modifications and variations that may be apparent to a person of skill in the art are included within the scope of the disclosure as defined by the accompanying claims.

What is claimed is:

1. A cold spray nozzle assembly for depositing a powder material onto a surface of a component, the nozzle assembly comprising:

a primary spray nozzle;

two or more secondary spray nozzles; and a nozzle support mechanism, the nozzle support mechanism being arranged to support each of the primary, and the two or more secondary, spray nozzles, wherein each of the primary, and the two or more secondary spray nozzles are aligned to deposit the powder material on a single target point on the surface, a reference plane being defined normal to a surface plane at the target point, the primary nozzle including a primary axis being positioned in a primary plane, the primary plane being normal to the surface plane and forming a primary dihedral angle with the reference plane, the primary axis of the primary nozzle defining a primary nozzle angle with the surface plane, the two or more secondary spray nozzles each including a secondary axis, each of the secondary axes being positioned in its own secondary plane of a plurality of secondary planes, each of the plurality of secondary planes being normal to the surface plane, and the plurality of secondary planes forming secondary dihedral angles with the reference plane such that each secondary plane of the plurality of secondary planes forms a secondary dihedral angle with the reference plane, and each of the secondary axes of the two or more secondary spray nozzles defining a respective secondary nozzle angle with the surface plane, and at least three axes, selected from the primary axis and each of the secondary axes of the two or more secondary spray nozzles, are not coplanar.

2. The cold spray nozzle assembly as claimed in claim 1, wherein one of the plurality of secondary planes is coplanar with the primary plane.

3. The cold spray nozzle assembly as claimed in claim 1, wherein the powder material is a metal powder or a metal alloy powder.

4. The cold spray nozzle assembly as claimed in claim 1, wherein the nozzle assembly comprises a primary spray nozzle, and two secondary spray nozzles.

5. The cold spray nozzle assembly as claimed in claim 4, wherein a first secondary nozzle angle is 45° to the surface plane at the target point, and a second secondary nozzle angle is 135° to the surface plane at the target point.

6. The cold spray nozzle assembly as claimed in claim 4, wherein a first secondary nozzle angle is between 45° and 70° to the surface plane at the target point, and a second secondary nozzle angle is between 110° and 135° to the surface plane at the target point.

7. The cold spray nozzle assembly as claimed in claim 1, wherein the primary nozzle angle is 90° to the surface plane at the target point.

8. The cold spray nozzle assembly as claimed in claim 7, wherein a first secondary nozzle angle is 45° to the surface plane at the target point, and a second secondary nozzle angle is 135° to the surface plane at the target point.

9. The cold spray nozzle assembly as claimed in claim 7, wherein a first secondary nozzle angle is between 45° and 70° to the surface plane at the target point, and a second secondary nozzle angle is between 110° and 135° to the surface plane at the target point.

10. The cold spray nozzle assembly as claimed in claim 1, wherein the primary nozzle discharges a first powder material at a first pre-determined discharge velocity, a first secondary nozzle discharges a second powder material at a second pre-determined discharge velocity, and a second secondary nozzle discharges a third powder material at a third pre-determined discharge velocity.

11. The cold spray nozzle assembly as claimed in claim 10, wherein each of the second powder material and/or the third powder material is different from the first powder material.

12. The cold spray nozzle assembly as claimed in claim 10, wherein each of the first pre-determined discharge velocity, the second pre-determined discharge velocity, and the third pre-determined discharge velocity, is selected in dependence on a thermo-mechanical property of the corresponding powder material.

13. The cold spray nozzle assembly as claimed in claim 11, wherein each of the first pre-determined discharge velocity, the second pre-determined discharge velocity, and the third pre-determined discharge velocity, is selected in dependence on a thermo-mechanical property of the corresponding powder material.

14. The cold spray nozzle assembly as claimed in claim 12, wherein the thermo-mechanical property is selected from the group comprising melting point, yield point, flow stress, fracture toughness and strain energy release rate.

15. The cold spray nozzle assembly as claimed in claim 1, wherein the support mechanism is adjustable to alter an orientation of each of the primary spray nozzle and the two or more secondary spray nozzles.

16. A method of depositing a powder material onto a single target point on a surface of a component using a cold spray nozzle assembly, the cold spray nozzle assembly (100) comprising a nozzle support mechanism, the method comprising the steps of:

arranging the nozzle support mechanism to support each of a primary spray nozzle and two or more secondary spray nozzles;

defining a reference plane normal to a surface plane at the target point;

positioning a primary axis of the primary nozzle in a primary plane, the primary plane being normal to the surface plane and forming a primary dihedral angle with the reference plane;

positioning a secondary axis of each of the two or more secondary spray nozzles, in its own secondary plane of a plurality of secondary planes, each of the plurality of secondary planes being normal to the surface plane, and the plurality of secondary planes forming secondary dihedral angles with the reference plane such that each secondary plane of the plurality of secondary planes forms a secondary dihedral angle with the reference plane, and each of the secondary axes of the two or more secondary spray nozzles defining a respective secondary nozzle angle with the surface plane;

depositing powder material on the target point using the primary spray nozzle; and depositing powder material on the target point using each of the two or more secondary spray nozzles, wherein at least three axes, selected from the primary axis and each of the secondary axes of the two or more secondary spray nozzles, are not coplanar.

17. The method as claimed in claim 16, wherein the step of depositing powder material on the target point using the primary spray nozzle, comprises the step of:

discharging a first powder material through the primary spray nozzle at a first pre-determined discharge velocity to deposit the first powder material on the target point;

and the step of depositing powder material on the target point using each of the two or more secondary spray nozzles, comprises the step of:

discharging second and further powder materials through respective ones of the two or more secondary spray nozzles at corresponding second and further pre-determined discharge velocities to deposit the second and further powder materials on the target point.

18. The method as claimed in claim 16, wherein the support mechanism is adjustable to alter an orientation of each of the primary spray nozzle and the two or more secondary spray nozzles.

* * * * *